US005481179A

United States Patent [19]

Keeth

[11] Patent Number: 5,481,179

[45] Date of Patent: Jan. 2, 1996

[54] VOLTAGE REFERENCE CIRCUIT WITH A COMMON GATE OUTPUT STAGE

[75] Inventor: Brent Keeth, Boise, Id.

[73] Assignee: Micron Technology, Inc., Boise, Id.

[21] Appl. No.: 342,392

[22] Filed: Nov. 17, 1994

Related U.S. Application Data

[63] Continuation of Ser. No. 137,679, Oct. 14, 1993, abandoned.

[51] Int. Cl.[6] ..... G05F 3/26

[52] U.S. Cl. ..... 323/315; 327/543

[58] Field of Search ..... 323/312, 313, 323/315; 327/530, 538, 543

[56] References Cited

U.S. PATENT DOCUMENTS

| | | | |
|---|---|---|---|
| Re. 30,586 | 4/1981 | Brokaw | 323/314 |
| 5,120,994 | 6/1992 | Joly | 307/296.6 |
| 5,132,556 | 7/1992 | Cheng | 307/296.7 |
| 5,136,182 | 8/1992 | Fawal | 307/296.8 |
| 5,208,527 | 5/1993 | Poletto et al. | 323/313 |
| 5,227,714 | 7/1993 | Lou | 323/282 |
| 5,245,273 | 9/1993 | Greaves et al. | 323/313 |
| 5,250,911 | 10/1993 | Linder et al. | 330/149 |
| 5,266,886 | 11/1993 | Landgraf | 323/314 |

OTHER PUBLICATIONS

CMOS Analog Circuit Design, Philip Allen & Douglas Holberg, 1987, pp. 246 to 249.

Microelectronic Circuits, Adel Sedra & Kenneth Smith, 1987, pp. 378 to 380, 506 and 507.

*Primary Examiner*—Peter S. Wong
*Assistant Examiner*—Adolf Berhane
*Attorney, Agent, or Firm*—Schwegman, Lundberg & Woessner

[57] ABSTRACT

A voltage reference circuit, powered by a single supply voltage, is of the type having a bootstrapped $V_T$ reference source that is based on a current mirror. The voltage reference circuit includes an output stage having two transistors in series with a load resistor and outputs a regulated reference voltage generated across the load resistor. The gate of each transistor in the output stage is coupled to one node of the current mirror. At least one of the output transistors is, thus, in a common-gate amplifier configuration. The two transistor output stage provides improved regulation so that the output voltage is independent of variation in the supply voltage.

28 Claims, 4 Drawing Sheets

VOLTAGE REFERENCE CIRCUIT WITH A COMMON GATE OUTPUT STAGE

This is a continuation of application Ser. No. 08/137,679 filed Oct. 14, 1993 now abandoned.

FIELD OF THE INVENTION

The present invention relates to integrated circuits (ICs). Particularly, there is a device and method for creating a constant reference voltage within an IC given a range of external voltages supplied to the IC. Uniquely, the invention uses a bootstrap circuit, a Vt referenced source and a series transistor output stage.

BACKGROUND OF THE INVENTION

Over the last decade or so, semiconductors have become an essential tool in building consumer products. During this time, ICs have needed to shrink in physical size so that the consumer products can be smaller. ICs have also needed to increase in performance. For example memory chips have quadrupled in memory size about every two to five years. Now, ICs must use less power to operate in the new battery powered portable consumer products. Thus, the IC has moved from requiring 12 volts to 3.3 volts and even less. Consumers expect smaller products that run longer between recharges, while having a vast array of options.

For the purpose of providing background material which may in some respects illustrate the state of the art, consider the circuit of FIG. 5 which shows an example of a $V_T$ referenced source, also called a bootstrap reference. M3 and M4 cause the currents $I_1$ and $I_2$ to be equal. $I_1$ flows through M1 creating a voltage $V_{GS1}$. $I_2$ flows through R creating a voltage $I_2R$. Because these two voltages are connected together, an equilibrium point is established. The equation describing this equilibrium point Q is given as $$I_2R = V_{T1} + \frac{2I_1L_1}{K'_NW_1}$$

This equation can be solved iteratively for $I_1=I_2=I_Q$ or alternately, one can assume that $V_{GS1}$ is approximately equal to $V_{T1}$ so that $$I_Q = I_2 = \frac{V_{T1}}{R}$$

Since $I_1$ or $I_2$ does not change as a function of $V_{DD}$, the sensitivity of $I_Q$ to $V_{DD}$ is essentially zero. A voltage reference can be achieved by mirroring $I_2$ ($=I_Q$) through M5 or M6 and using a resistor.

Unfortunately there are two possible equilibrium points. One is at Q and the other is at zero. In order to prevent the circuit from choosing the wrong equilibrium point, a start-up circuit is necessary. The dotted circuit functions as a start-up circuit. If the circuit is at the undesired equilibrium point, then $I_1$ and $I_2$ are zero. However, M7 will provide a current in M1 that will cause the circuit to move to the equilibrium point at Q. As the circuit approaches the point Q, the source voltage of M7 increases causing the current through M7 to decrease. At Q the current through M1 is essentially the current through M3.

Problems

Today, consumer products need to function from either a battery source, with its inherent decreasing voltage over time, or a constant energy source derived from your standard wall sockets. As a consequence, ICs must be able to operate from a variety of power supply voltages without damage to their circuits. Therefore, there is a need for an IC that can receive a range of power supply voltages yet deliver a constant voltage to its internal circuits.

It is noted that the above described problems, as well as other problems, are solved through the subject invention and will become more apparent, to one skilled in the art, from the detailed description of the subject invention.

SUMMARY OF THE INVENTION

One skilled in the art will appreciate the advantage of a voltage reference circuit with common gate loading and bootstrapping. Specifically, there is a circuit that can receive a range of power supply voltages and yet maintain a constant reference voltage output. Uniquely, the invention uses a bootstrapped circuit, a Vt referenced source, a current mirror, and a gain of 2 operational amplifier.

Other features and advantages of the present invention may become more clear from the following detailed description of the invention, taken in conjunction with the accompanying drawings and claims, or may be learned by the practice of the invention.

Figure 1:
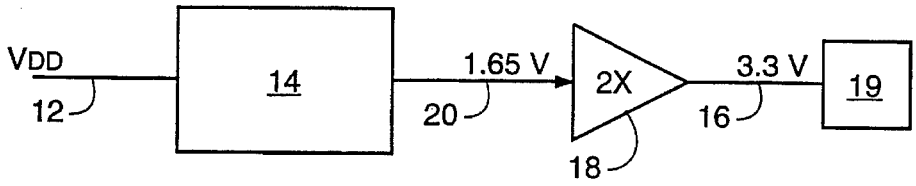
FIG. 1 is a general overall view of the invention.

It is noted that the drawings of the invention are not to scale. The drawings are merely schematic representations, not intended to portray specific parameters of the invention. The drawings are intended to depict only typical embodiments of the invention, and are therefore not to be considered limiting of its scope. The invention will be described with additional specificity and detail through the use of the accompanying drawings, specification, and claims. Additionally, like numbering in the drawings represent like elements within and between all drawings.

DETAILED DESCRIPTION OF THE ILLUSTRATED EMBODIMENT

This disclosure of the invention is submitted in furtherance of the constitutional purposes of the U.S. Patent Laws "to promote the progress of science and useful arts" (Article 1, Section 8 of the U.S. Constitution).

One skilled in the semiconductor power supply design art will easily understand the operation of a CMOS P-channel bootstrapped voltage reference circuit having common gate loading.

Referring to FIG. 1, there is a general illustration of the invention, having the following elements: An external variable power supply 12, entering a circuitry 14, creates a reference voltage on node 20 (being 1.65 volts), and enters a times two operational amplifier 18 and outputs the desired voltage (like 3.3 voltage) on output node 16 that can be used by the internal circuits of the IC 19.

Figure 2:
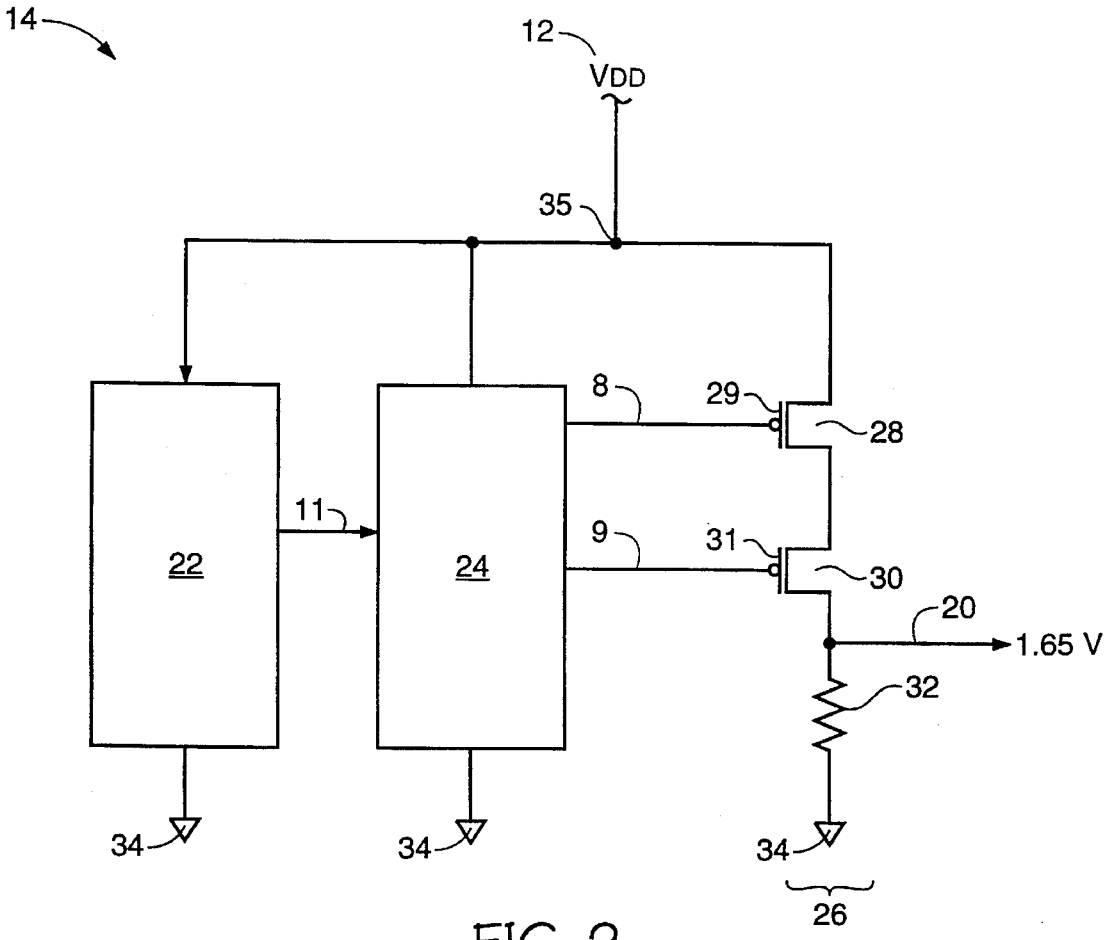
FIG. 2 is a more detailed illustration of the invention.

Referring to FIG. 2, there is a more detailed illustration of the reference voltage circuitry 14, having the following elements: External power supply 12, enters three circuits; a bootstrap circuit 22, a Vt referenced source circuit 24 and a output stage 26. The current mirror has two in series P-channel transistors 28 and 30, having common node 21 therebetween, each having their gates 29 and 31 coupled to the Vt referenced source circuit 24 via lines or nodes 8 and 9. Transistor 30 serves as a common gate load for transistor 29, ensuring linear operation and also desensitizing the output stage to power supply variations. The output of a constant voltage, for example 1.65 volts, on node 20 is therefore created, and there is a resistor device 32 coupled from node 20 to ground 34.

Figure 3:
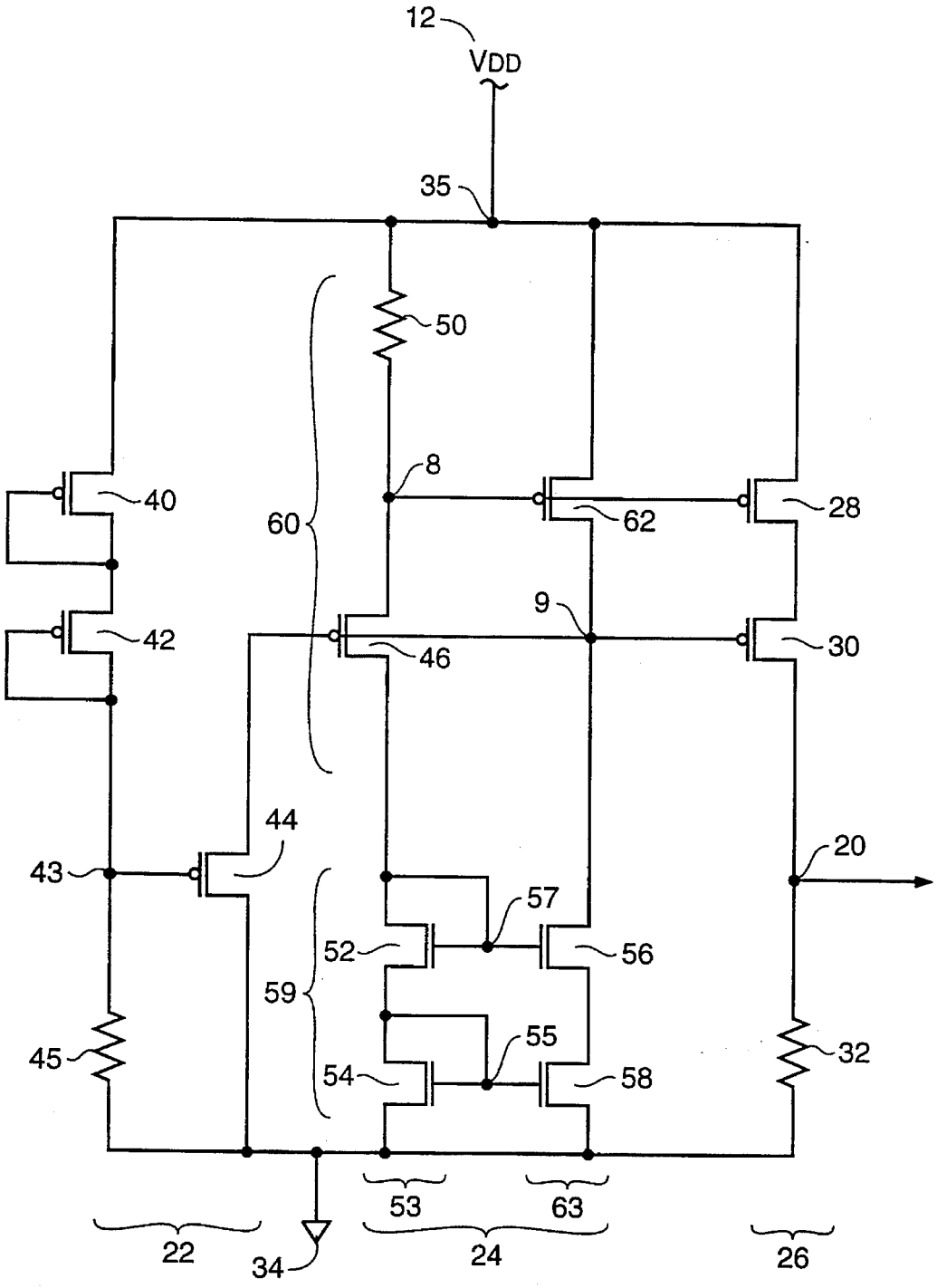
FIG. 3 is the most detailed illustration of the invention.

Referring to FIGS. 2 and 3, there is illustrated a more detailed schematic of the invention's bootstrapped circuit 22 and Vt referenced source circuit 24. Bootstrap circuit 22 has two P-channel diodes 40 and 42 connected between node 43 and the power supply node 35. A resistor 45 is coupled between node 43 and ground 34. P-channel transistor 44 has its gate connected to node 43 and a first terminal coupled to ground 34 and a second terminal connected to node 9 located in the Vt circuit.

The Vt referenced source circuit 24 has two main circuits; a current determining circuit 60 and a cascaded circuit 59. Additionally the overall Vt referenced circuit is made up of two rail to rail circuits 53 and 63. The current determining circuit has a resistor 50 coupled between supply voltage node 35 and node 8, and has a P-channel transistor 46 has one terminal coupled to node 8 and its gate coupled to node 9. Circuit 63 has a P-channel transistor 62 having one terminal coupled to power supply node 35, the other terminal coupled to node 9, and the gate coupled to node 8.

Cascaded circuit 59 includes two current mirrors. N-channel transistors 52 and 56 form a first current mirror and N-channel transistors 54 and 58 form a second current mirror.

Figure 4:
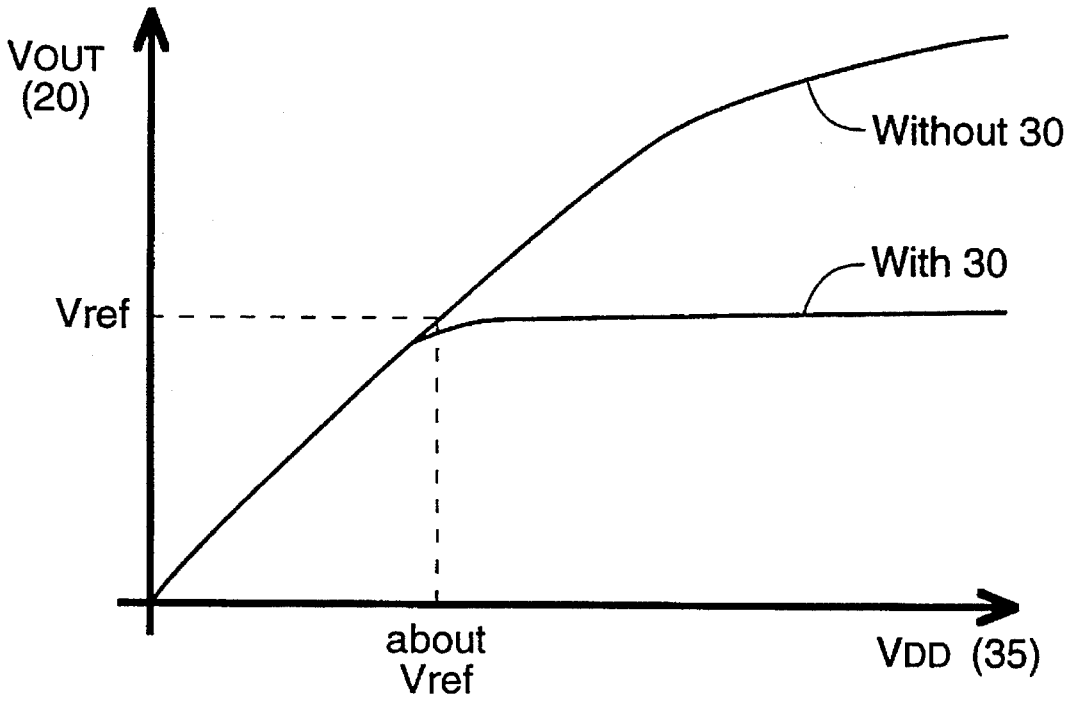
FIG. 4, is a graph of the circuit with and without the additional transistor.
Figure 5:
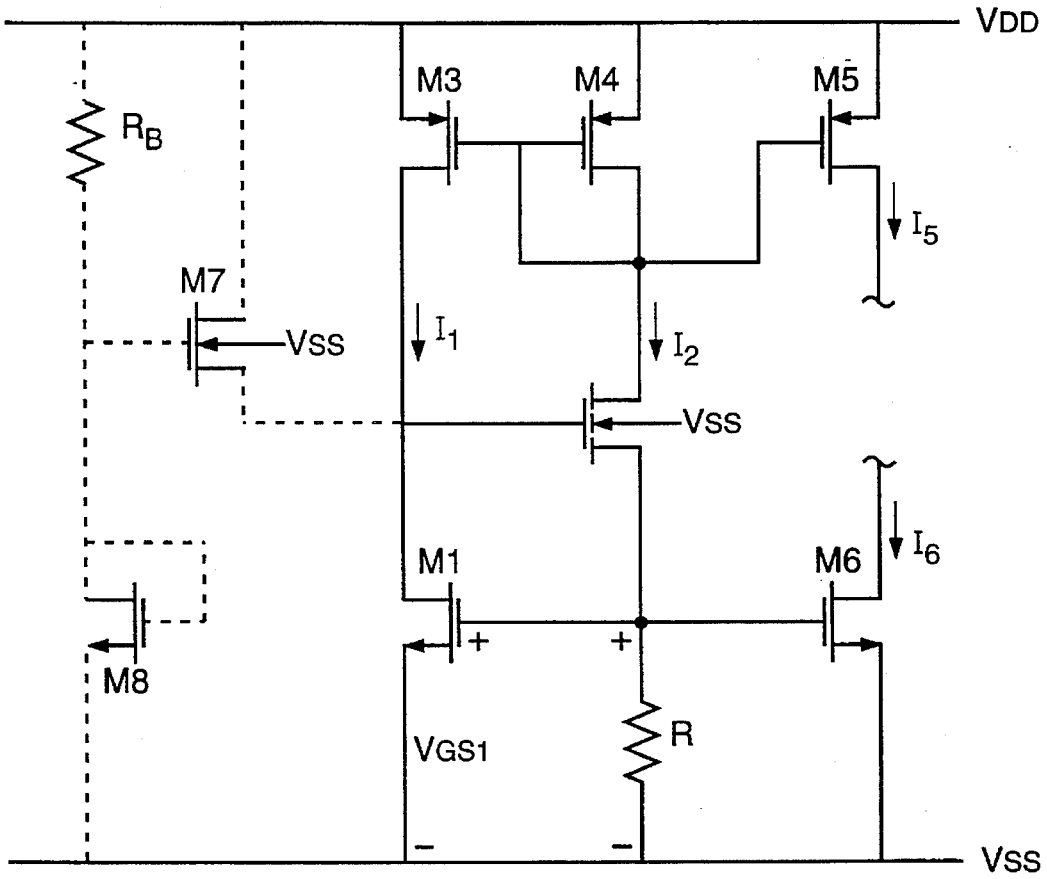
FIG. 5 (PRIOR ART)
FIG. 5 is a schematic diagram of a known $V_T$ reference source.

Referring to FIG. 4, there is a graph illustrating the effects of incorporating transistor 30, acting as the common gate load, to achieve a linear voltage reference for a variable voltage source on node 35.

Operation of the Invention

One skilled in the art would understand the operation of the invention. The following is a discussion of parts of the operation of the invention and is not meant to be comprehensive.

The purpose of using a bootstrap circuit 22 is obvious to one skilled in the art. Specifically, device 46 is guaranteed of turning on because of the pulldown effect of the bootstrap circuit 22 that makes sure that the Vt referenced source circuit 24 will not maintain an equilibrium of zero volts.

Once device 46 is activated from the bootstrap circuit, current can then proceed to the cascaded circuit 59. Specifically, the current passing through resistor 50 can pass through transistor 46, and turn on the two diodes 52 and 54, and simultaneously turn on transistors 56 and 58 since their gates have common nodes 57 and 55 respectively.

Once current flows through circuit 53, a whole series of other events can occur that effect the gate voltages of the transistors 28 and 30 to provide the needed voltage on node 20. P-channel transistors 62 and 28 are simultaneously activated with gate voltages from node 8. This layout provides a constant current through circuit 26.

It is transistor 30 that is the key to the invention. As illustrated in FIG. 4, without device 30 the voltage of the output node 20 will vary with the input voltage on node 35. However, with device 30 the characteristics of circuit 26 are linearized. Thus, device 30 gives a constant voltage at node 20 and across resistor 32.

It is noted that circuit 14 acts as a regulator that receives variable voltages and outputs only a specified voltage of, for example 1.65 volts.

One should note that it is the gate voltage of transistor 30 that is the key component of the invention that will maintain the requisite voltage.

It is also noted that transistor 46 is what is common to both the gates of transistors 28 and 30, thus providing feedback between circuits 53 and 63, so as to regulate the voltages of these gates in response to the changing supply voltages.

Variations in the Invention

There are several obvious variations to the broad invention and thus come within the scope of the present It is obvious that this circuit could create most any voltage onto node 20 and use an appropriate operational amplifier to create the requisite voltage needed for the operation of the internal circuits in the integrated circuit.

Of course this circuit may have several control switches and resistors added where necessary to control the timing of the whole operation of generating a reference voltage. Control switches may be placed, just for example, in the bootstrap circuit to turn it on and off. The same applies to each of the other circuits discussed in this specification.

Of course it is an obvious design modification in reference to the ground node 34. This node could just operate like another rail except with a lower voltage than node 35 but higher than ground voltage; the invention will work the same.

Another obvious design modification is to change the resistors to transistors with specifications designed to act like a resistor.

Another modification can be to have all the devices in this invention have their substrates biased jointly or in partitioned portions.

Furthermore, any type of operational amplifier that can double, or triple, etc. the voltage. For example, it may be useful to use one that uses cascaded transistor circuitry for balancing the op amp to the rest of the invention.

While the invention has been taught with specific reference to these embodiments, someone skilled in the art will recognize that further changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

Although subheadings in the Detailed Description of the Illustrated Embodiment are used, these are merely provided for assisting the reader; wherein, the writer is free to enter any information under any heading/s.

What is claimed and desired to be secured by United States Patent is:

1. An integrated circuit for generating an output voltage, the circuit comprising:

a. a current mirror comprising a reference node and a mirrored node, wherein during operation current through the reference node is equal to current through the mirrored node;

b. biasing means for establishing a current through the reference node;

c. a first regulator for regulating current through the mirrored node, the first regulator comprising a first control terminal coupled to the reference node; and d. an output stage for regulating an output current so that the output voltage is generated across a load resistor when the output current passes therethrough, the output stage comprising:

(1) a second regulator for regulating the output current, the second regulator comprising a second control terminal coupled to the reference node; and (2) a third regulator in series with the second regulator for regulating the output current, the third regulator comprising a third control terminal coupled to the mirrored node.

2. The integrated circuit of claim 1 wherein the current mirror further comprises a switch for interrupting current flow through the reference node.

3. The integrated circuit of claim 2 further comprising a bootstrap circuit coupled to the switch to operate the switch so that during operation, current through the mirrored node is nonzero.

4. The integrated circuit of claim 1 wherein the current mirror comprises a pair of mirror circuits coupled in series.

5. The integrated circuit of claim 4 wherein the current mirror comprises four field effect transistors intercoupled to form the pair of mirror circuits coupled in series.

6. The integrated circuit of claim 1 wherein the biasing means comprises a power supply in series with a resistor.

7. The integrated circuit of claim 1 wherein the first regulator comprises a field effect transistor having a first gate, and the first control terminal is coupled to the first gate.

8. The integrated circuit of claim 1 wherein the second regulator comprises a field effect transistor having a second gate, and the second control terminal is coupled to the second gate.

9. The integrated circuit of claim 1 wherein the third regulator comprises a field effect transistor having a third gate, and the third control terminal is coupled to the third gate.

10. An integrated circuit operative between a first potential and a second potential, the circuit for generating an output voltage, the circuit comprising:

a. a first device having a first resistance, the first device coupled between the first potential and a first network node;

b. a first field effect transistor comprising:

(1) a first gate coupled to the first node; and (2) a first channel;

c. a second field effect transistor comprising:

(1) a second gate; and (2) a second channel, the first channel and the second channel being sequentially coupled in series between the first potential and the second potential;

d. a second network node in series between the first channel and the second channel;

e. a third field effect transistor comprising:

(1) a third gate coupled to a third network node, the third node coupled to the first node;

(2) a third channel coupled between the third node and the second potential;

f. a second device having a second resistance, the second device coupled in series between a fourth network node and the second potential;

g. a fourth field effect transistor comprising:

(1) a fourth gate coupled to the first gate; and (2) a fourth channel; and h. a fifth field effect transistor comprising:

(1) a fifth gate coupled to the second node; and (2) a fifth channel, the fourth channel and the fifth channel being sequentially coupled in series between the first potential and the fourth node so that in operation the output voltage is provided at the fourth node.

11. The integrated circuit of claim 10 wherein coupling is by direct connection.

12. The integrated circuit of claim 10 wherein the first potential is more positive than the second potential.

13. The integrated circuit of claim 10 wherein the second potential is more positive than the first potential.

14. The integrated circuit of claim 10 wherein one of the set consisting of the first potential and the second potential is ground.

15. The integrated circuit of claim 10 further comprising a sixth field effect transistor comprising a channel coupled in series between the first node and the third node.

16. The integrated circuit of claim 15 wherein coupling is by direct connection.

17. The integrated circuit of claim 10 further comprising:

a. a seventh field effect transistor comprising:

(1) a seventh channel coupled in series between the third channel and the second potential; and (2) a seventh gate; and b. an eighth field effect transistor comprising:

(1) an eighth gate coupled to the seventh gate; and (2) an eighth channel coupled in series between the second channel and the second potential.

18. The integrated circuit of claim 17 wherein coupling is by direct connection.

19. The integrated circuit of claim 10 wherein the first device comprises a semiconductor.

20. The integrated circuit of claim 10 wherein the second device comprises a semiconductor.

21. A circuit for providing a regulated voltage, the circuit operable between at least two supply rails, the circuit comprising:

a. a circuit for providing a reference voltage;

b. a first branch for conducting a first current between the supply rails, and for establishing a first voltage responsive to the first current, the first branch comprising:

(1) means for limiting the first current;

(2) a first node characterized by the first voltage; and (3) a first transistor,.coupled to the first node and responsive to the reference voltage, for further limiting the first current;

c. a second branch for conducting a second current between the supply rails, and for establishing a second voltage responsive to the second current, the second branch comprising:

(1) a second transistor responsive to the first voltage; and (2) a second node characterized by the second voltage;

d. a circuit for controlling the second current so that it mirrors the first current; and e. a third branch for conducting a third current between the supply rails, the third branch comprising:

(1) a third transistor for limiting the third current in response to the first voltage;

(2) a fourth transistor for further limiting the third current in response to the second voltage; and (3) a load for establishing the output voltage in response to the third current.

22. The circuit of claim 21 wherein the means for limiting the first current comprises a resistor.

23. The circuit of claim 21 wherein the means for limiting the first current comprises a semiconductor.

24. The circuit of claim 21 wherein the first, the second, the third, and the fourth transistors each comprise a field effect transistor.

25. The circuit of claim 21 wherein the circuit for controlling the second current comprises at least two field effect transistors coupled to form a current mirror circuit.

26. The circuit of claim 21 wherein the circuit for controlling the second current comprises at least four field effect transistors coupled to form a first current mirror in series with a second current mirror.

27. The circuit of claim 21 wherein the load comprises a resistor.

28. The circuit of claim 21 wherein the load comprises a semiconductor.

* * * * *

UNITED STATES PATENT AND TRADEMARK OFFICE

CERTIFICATE OF CORRECTION

PATENT NO. : 5,481,179

DATED : January 2, 1996

INVENTOR(S) : Brent Keeth

It is certified that error appears in the above-indentified patent and that said Letters Patent is hereby corrected as shown below:

Column 2 Line 57 please insert --GENERAL EMBODIMENT-- therefor.

Column 3 Line 25 please delete "in the Vt circuit" and insert -- in the Vt referenced source circuit 24 on circuit 63--

Column 4 Line 21 please delete "present" and insert --present invention.-- therefor.

Column 6 Line 51 please delete "(2)" and insert --(2)-- therefor.

Column 6 Line 52 please delete "transistor,." and insert --transistor,-- therefor.

Signed and Sealed this

Third Day of September, 1996

*Attest:*

Bruce Lehman

BRUCE LEHMAN

*Attesting Officer*

*Commissioner of Patents and Trademarks*